US009714524B2

(12) United States Patent
Parish-Allaire

(10) Patent No.: US 9,714,524 B2
(45) Date of Patent: Jul. 25, 2017

(54) FORCE TRANSMISSION DEVICE

(71) Applicant: Kristine L. Parish-Allaire, Las Vegas, NV (US)

(72) Inventor: Kristine L. Parish-Allaire, Las Vegas, NV (US)

( * ) Notice: Subject to any disclaimer, the term of this patent is extended or adjusted under 35 U.S.C. 154(b) by 0 days.

(21) Appl. No.: 15/019,433

(22) Filed: Feb. 9, 2016

(65) Prior Publication Data

US 2016/0230415 A1 Aug. 11, 2016

Related U.S. Application Data

(60) Provisional application No. 62/176,036, filed on Feb. 9, 2015.

(51) Int. Cl.

| | |
|---|---|
| ***E05B 1/00*** | (2006.01) |
| ***E05B 5/00*** | (2006.01) |
| ***E05B 53/00*** | (2006.01) |
| ***E05B 15/16*** | (2006.01) |
| *E05B 65/00* | (2006.01) |
| *E05B 65/08* | (2006.01) |

(52) U.S. Cl.

CPC ..... *E05B 1/0015* (2013.01); *E05B 15/1607* (2013.01); *E05B 53/001* (2013.01); *E05B 65/0025* (2013.01); *E05B 65/08* (2013.01)

(58) Field of Classification Search

CPC ... Y10T 16/458; Y10T 16/462; Y10T 16/506; Y10T 16/476; Y10T 292/57; Y10T 16/19; E05B 1/00; E05B 1/0053; E05B 1/0069; E05B 1/0015; E05B 3/001; E05B 65/0025; E05B 65/08; E05B 15/1607; A47B 95/02; E05F 13/02; E05F 5/05; E05Y 2900/112; E05Y 2201/676; E05Y 2201/68; F16B 47/00

See application file for complete search history.

(56) References Cited

U.S. PATENT DOCUMENTS

| | | | | |
|---|---|---|---|---|
| 3,391,674 A * | 7/1968 | Burleigh | ..... | A01K 1/035 119/174 |
| 4,084,290 A * | 4/1978 | Lymar | ..... | E05C 17/54 16/82 |
| 4,208,841 A * | 6/1980 | Starks | ..... | E05D 13/06 24/450 |

(Continued)

FOREIGN PATENT DOCUMENTS

| | | | | |
|---|---|---|---|---|
| DE | 202013008712 U1 * | 10/2013 | ..... | E05B 1/0015 |
| FR | 2966746 A3 * | 5/2012 | ..... | E05B 1/0015 |

*Primary Examiner* — Chuck Mah

(57) ABSTRACT

A force transmission device configured to laterally displace a plane, such as a sliding door or glass, by joining with the plane and transmitting a lateral force to the plane. Once securely joined with the plane, the device forms a securely fastened, textured surface area enabling an object, such as a foot or hand, to laterally displace both the device and the attached plane. The device includes a base portion having a mount surface and an outer surface. The mount surface adheres to the plane through an adhesive portion. A cover portion may detachably cover the adhesive portion and be removed by a tab. A wedge portion having an apex end and a base end extends from the base portion to provide a surface for the object to apply a force on the device. The force is transmitted to the plane for lateral or pivotal displacement.

18 Claims, 6 Drawing Sheets

(56) References Cited

U.S. PATENT DOCUMENTS

| | | | | |
|---|---|---|---|---|
| 5,927,018 | A * | 7/1999 | Thain | E05B 53/001 16/86 R |
| 6,067,690 | A * | 5/2000 | Herman | E05B 53/001 16/412 |
| 6,189,183 | B1 * | 2/2001 | Hartselle, III | E05B 1/0015 16/412 |
| 6,866,328 | B1 * | 3/2005 | Mustybrook | B60J 5/0493 296/152 |
| 7,043,800 | B2 * | 5/2006 | Moody | E05B 53/001 16/412 |
| 7,717,068 | B2 * | 5/2010 | Wilson | A01K 15/02 119/174 |
| 8,752,334 | B1 * | 6/2014 | Vanduch | E05B 53/001 16/422 |
| 9,115,530 | B2 * | 8/2015 | Michael | E05F 11/54 |
| 2007/0271731 | A1 * | 11/2007 | Fuller | E05F 5/06 16/82 |
| 2014/0197648 | A1 * | 7/2014 | Brown | E05F 11/54 292/336.3 |

* cited by examiner

FORCE TRANSMISSION DEVICE

CROSS-REFERENCE TO RELATED APPLICATIONS

The present Utility patent application claims priority benefit of the U.S. provisional application for patent Ser. No. 62/176,036 Filed 9 Feb. 2015 under 35 U.S.C. 119(e). The contents of this related provisional application are incorporated herein by reference for all purposes to the extent that such subject matter is not inconsistent herewith or limiting hereof.

RELATED CO-PENDING U.S. PATENT APPLICATIONS

Not applicable.

INCORPORATION BY REFERENCE OF SEQUENCE LISTING PROVIDED AS A TEXT FILE

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to a force transmission device. More particularly, certain embodiments of the invention relates to a force transmission device that joins with a plane and transmits a lateral force that is applied to the device to the plane for the purpose of laterally displacing the plane.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that a sliding glass door or patio door, is a type of sliding door in architecture and construction. The sliding glass door can be a large glass window opening in a structure that provides gated access from a room to the outdoors, fresh air, and copious natural light.

Generally, the sliding glass door is usually considered a single unit consisting of two panel sections, one being fixed and one being mobile to slide open. Another design, a wall sized glass pocket door has one or more panels movable and sliding into wall pockets, completely disappearing for a 'wide open' indoor-outdoor room experience.

Often, the sliding door design has two panel sections, one fixed-stationary and one mobile to slide open. The actual sliding door is a movable rectangular framed sheet of window glass that is mounted parallel to a similar and often fixed similarly framed neighboring glass partition. The movable panel slides in a fixed track usually, and in its own plane parallel to the neighboring stationary panel.

Generally, a handle, or lever extends from a surface area and enables force to be leveraged and transmitted to the surface area. The handle can often be a part of, or attachment to, an object that can be moved or used by hand. In many instances, the design of each type of handle involves substantial ergonomic issues, even where these are dealt with intuitively or by following tradition.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 6A illustrates the force transmission device on an inner side of the plane, and FIG. 6B illustrates the force transmission device on an outer side of the plane, in accordance with an embodiment of the present invention.

Figure 1:
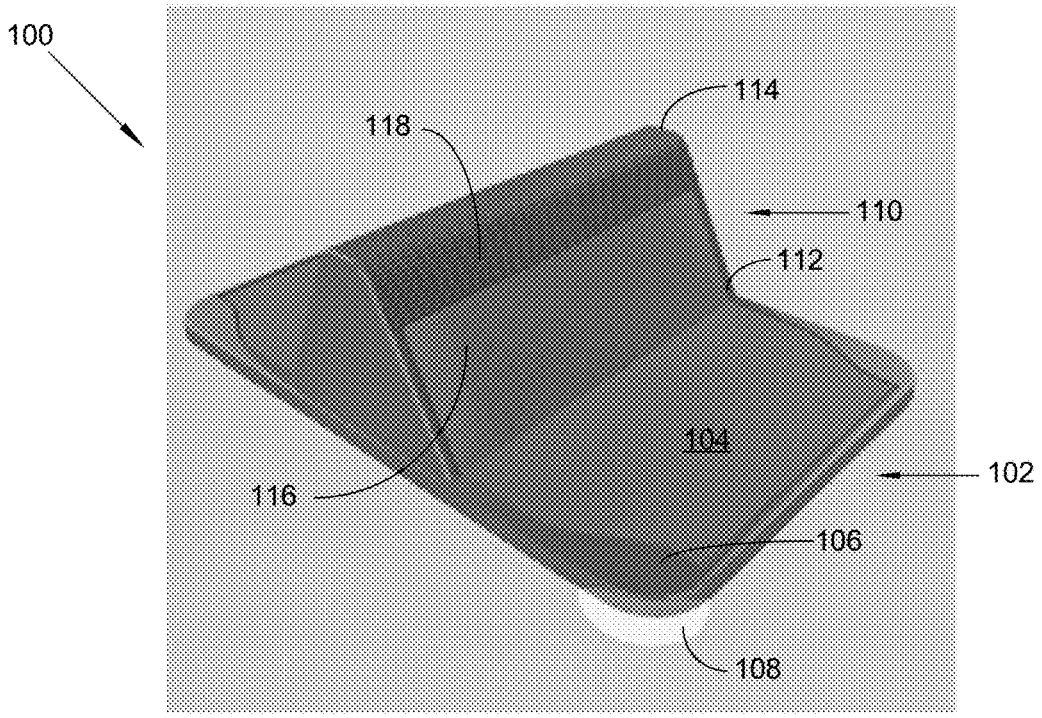
FIG. 1 illustrates a top angle perspective view of an exemplary force transmission device, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rocklatex Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. §112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to 'avoid a strict numerical boundary to the specified parameter, see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of. or interaction, with some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . ." Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. .sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

The present invention will now be described in detail with reference to embodiments thereof as illustrated in the accompanying drawings.

There are various types of handles for sliding doors and glass that may be provided by preferred embodiments of the present invention. FIG. 1 illustrates a perspective view of an exemplary force transmission device 100. In one embodiment, the force transmission device is configured to laterally displace a plane by joining with the plane and transmitting a lateral force to the plane. In some embodiments, the device may be configured to join with a plane, such as a sliding door or glass. Once securely joined with the plane, the device forms a securely fastened, textured surface area that enables an object, such as a foot or hand, to laterally displace both the device and the attached plane.

Thus, in one possible embodiment of use, the device provides a convenient tool that is usable in many households and other environments that feature sliding glass doors in order to make operation of said doors more convenient. In this manner, the device protects the glass of a sliding door from being directly kicked by a user, so as to prevent damage.

In some embodiments, the device may include a base portion 102. The base portion is configured to detachably join with the plane. The plane may include a glass door having a substantially smooth surface. However, in other embodiments, the plane may include, without limitation, a door, a window, and a drawer. The plane may be displaced laterally. However, in some embodiments, the device may pivotally displace the plane. The base portion may be configured in a substantially flat, rectangular shape. In one embodiment, the base portion is generally flat and dimensioned at about 6"×4"×⅓".

The size of the base portion is configured to engage sufficient area of the plane, so as to form a secure junction and enable lateral, or even pivotal displacement of the plane. The base portion covers enough surface area of the sliding door so it will help move a sliding glass door when pressure from a foot is applied to it. Those skilled in the art will recognize that if the base portion were too small or non-existent, the device would fall off the panel when a force or pressure is applied to it. And because the panel can be excessively heavy if the device was not attached it could be difficult to instigate movement of the door with minimal foot pressure. Thus, the base portion must cover sufficient amount of surface area of the panel.

In one embodiment, the base portion comprises a mount surface and an oppositely disposed outer surface 104. The surfaces of the base portion include a periphery that forms a generally curved shape, including radius corners and rounded edges. The curved configuration helps prevent materials and objects from snagging onto the base portion. The mount surface is configured to align in a coplanar disposition with the plane. Thus, through the use of radius corners and edges, a user is prevented from intentional or unintentional contact with the base portion from cutting, scrapping, poking or otherwise injury from a sharp corner.

In some embodiments, the mount surface may be configured to detachably attach to a plane. The mount surface is substantially flat like the plane, and thus a coplanar alignment is possible. The mount surface may include a resilient panel that overlays a substantial portion of the mount surface. The resilient panel is not rigid or angular, so as to help protect the panel from damage. In one possible embodiment, the resilient panel is a polyurethane foam of ¼" depth.

In some embodiments, an adhesive portion covers the resilient panel. The adhesive portion is configured to help adhere the base portion to the panel. In one embodiment, the adhesive portion is an ethylene vinyl adhesive. A cover portion may overlay a substantial portion of the adhesive portion. The cover portion enables selective covering of the adhesive portion. The adhesive portion is configured to adhere the base portion to the panel. In one embodiment, the cover portion is a wax paper that may be peeled off the adhesive portion. In some embodiments, a tab 108 may join with the edge of the cover portion. The tab may provide a handle that enables facilitated removal of the cover portion from the adhesive portion.

One exemplary mount surface includes a thin layer of foam padding coated with a durable adhesive. The adhesive is protected by a wax paper covering until the device is ready to be placed on a door. The foam provides additional protection to the glass door and also ensures the invention stays firmly mounted in place during repeated uses.

In some embodiments, the outer surface of the base portion is oppositely disposed from the mount surface. The outer surface may include a texture portion 106 that provides a grip for manipulation of the device. The texture portion may include a plurality of spaced-apart small bumps. The outer surface may also form the connective surface area for joining with a wedge portion 110 of the device.

In some embodiments, the wedge portion joins with the base portion. While the base portion is configured to join with the panel, the wedge portion provides a surface area that enables an object to transmit a force to the panel portion. The wedge portion may include a base end 112 and an apex end 114. A plurality of sidewalls 116 extend from the base end to the apex end. The wedge portion may form a generally V-shape from the apex end to the base end. The wedge portion is ergonomic in its shape and components. In this manner, minimal force or damage to the plane is needed to displace the plane.

In some embodiments, the base end of the wedge portion may join with the outer surface of the base portion. The wedge portion may be centrally disposed along the length of the base portion. In one embodiment, the wedge portion is permanently affixed to the base portion. The apex and a portion of the sidewalls may include a plurality of ridges 118. The ridges may be parallel and spaced-apart. The ridges are configured to grip an object, such that the object that is applying force to the wedge does not slip. This enables the object to transmit an optimal amount of force to the device for displacing the panel. Further, a top surface area of the sidewalls of the wedge portion that do not have ridges may be slightly textured.

Figure 2:
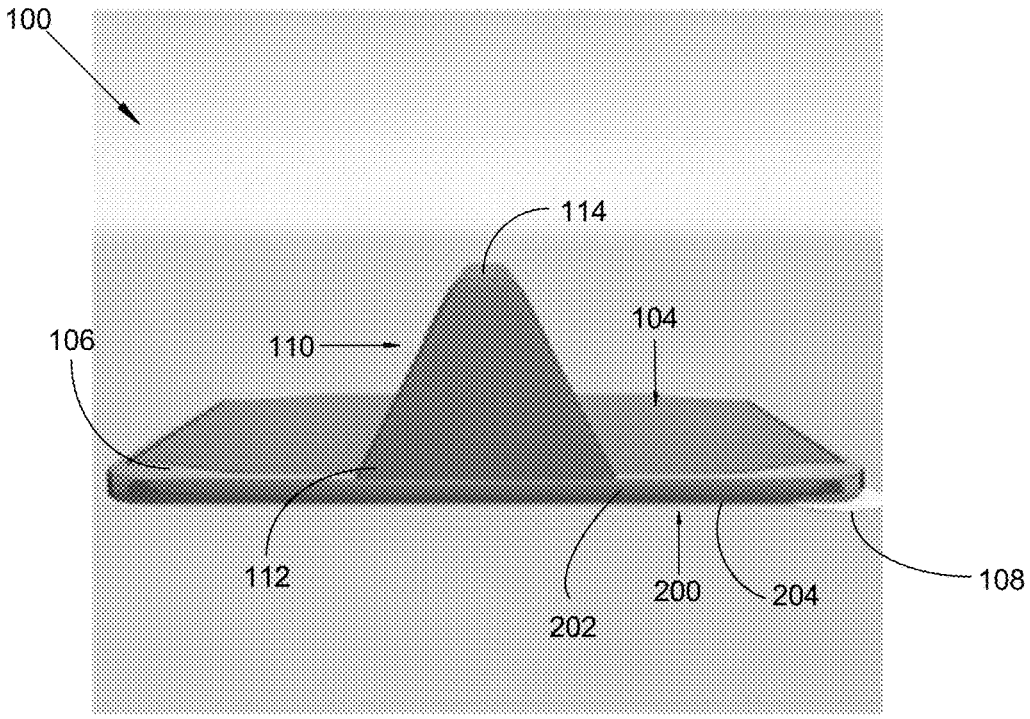
FIG. 2 illustrates a sectioned view of a force transmission device, in accordance with an embodiment of the present invention.

FIG. 2 illustrates a sectioned view of a force transmission device. This view illustrates the wedge portion. Similar to the base portion, the wedge portion, and specifically the base end, apex end, and sidewalls of the wedge portion include a periphery that forms a generally curved shape, including radius corners and rounded edges. The curved configuration helps prevent materials and objects from snagging onto the wedge portion. In one possible embodiment, the wedge portion is a triangular wedge measuring about 2"×4"×1½", tapering to ½" at the apex end.

As discussed above, the base portion includes a mount surface 200 that fixedly attaches to the plane. The mount surface comprises multiple layers that work together to form a secure mount that is safe for the panel. This may be especially important when the panel is glass.

One of the layers of the mount surface is a resilient panel 202. The resilient panel is configured to overlay a substantial portion of the mount surface. The resilient panel is not rigid or angular, so as to help protect the panel from damage. In one possible embodiment, the resilient panel is a polyurethane foam of ¼" depth.

Coating the resilient panel is an adhesive portion 204. The adhesive portion at least partially coats the resilient panel. The adhesive portion is configured to help adhere the base portion to the panel. In one embodiment, the adhesive portion is an ethylene vinyl adhesive. A cover portion may overlay a substantial portion of the adhesive portion. The cover portion enables selective covering of the adhesive portion. The adhesive portion is configured to adhere the base portion to the panel. In one embodiment, the cover portion is a wax paper that may be peeled off the adhesive portion.

Figure 3:
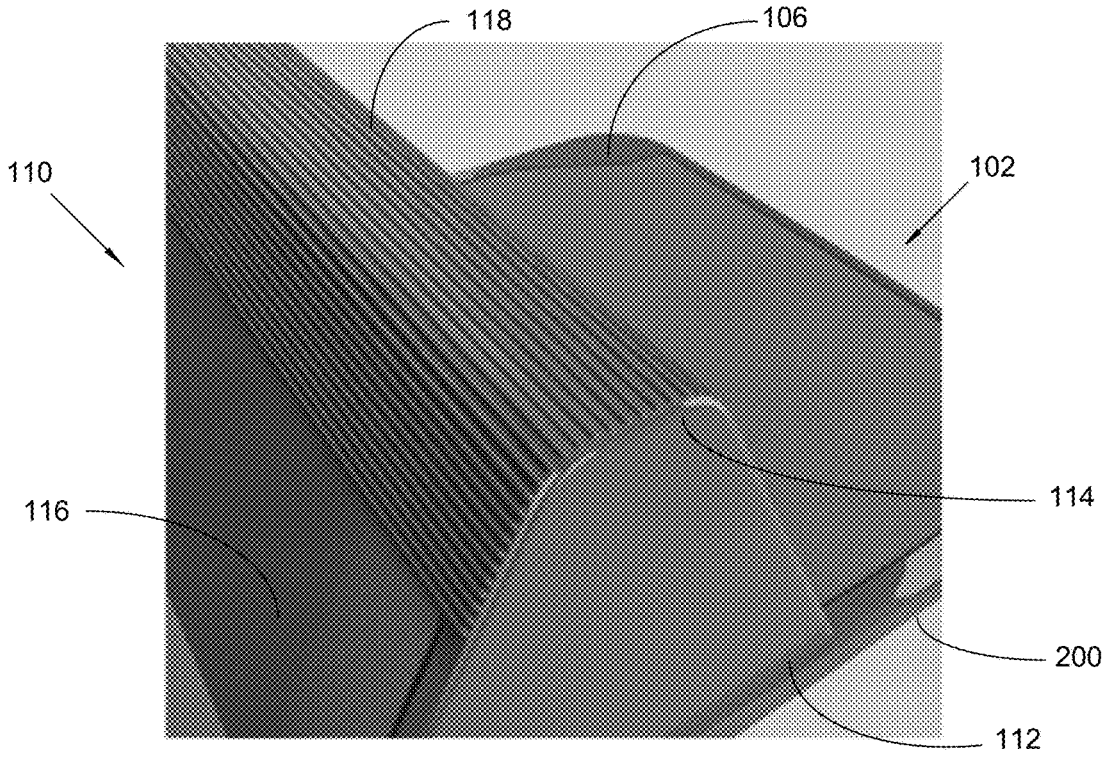
FIG. 3 illustrates a close up view of an exemplary wedge portion of a force transmission device, in accordance with an embodiment of the present invention.

FIG. 3 illustrates a close up view of an exemplary wedge portion of a force transmission device. The wedge portion may absorb heavy amounts of pressure and force from multiple angles. Thus, the wedge portion must not only inhibit slippage by the object, but also be durable enough to withstand these forces. In some embodiments, the device may be fabricated from a durable plastic material of adequate tolerance to heat, ozone, and other outdoor elements, ensuring durability of the device placed on the exterior plane, such as a sliding glass door. The device may also be fabricated from material with adequate resistance to alkalis and acids, ensuring durability of the device should it make contact with common household cleaning products. Suitable materials for the base portion and the wedge portion may include, without limitation, polyvinyl chloride (PVC), butyl rubber, hypalon rubber, low-density polyethylene (LDPE), metal, and polymers.

Figure 4:
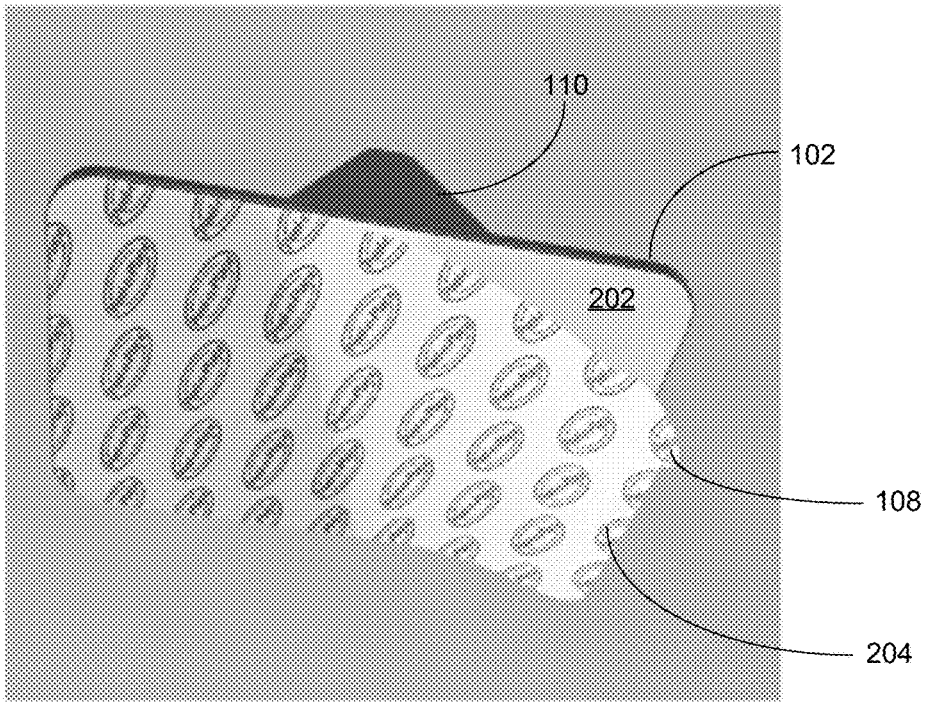
FIG. 4 illustrates a bottom angle perspective view of an exemplary cover portion peeling off a mount surface of an exemplary base portion, in accordance with an embodiment of the present invention.

FIG. 4 illustrates a bottom angle perspective view of an exemplary cover portion peeling off a mount surface of an exemplary base portion. The base portion, as described above, must affix to the plane with sufficient strength to withstand the forces and pressure. To help in this function, the cover portion does not expose the adhesive portion to air until ready to join with the plane. The cover portion may include a wax paper that is pulled off the adhesive portion with the tab, as illustrated in FIG. 4.

Figure 5:
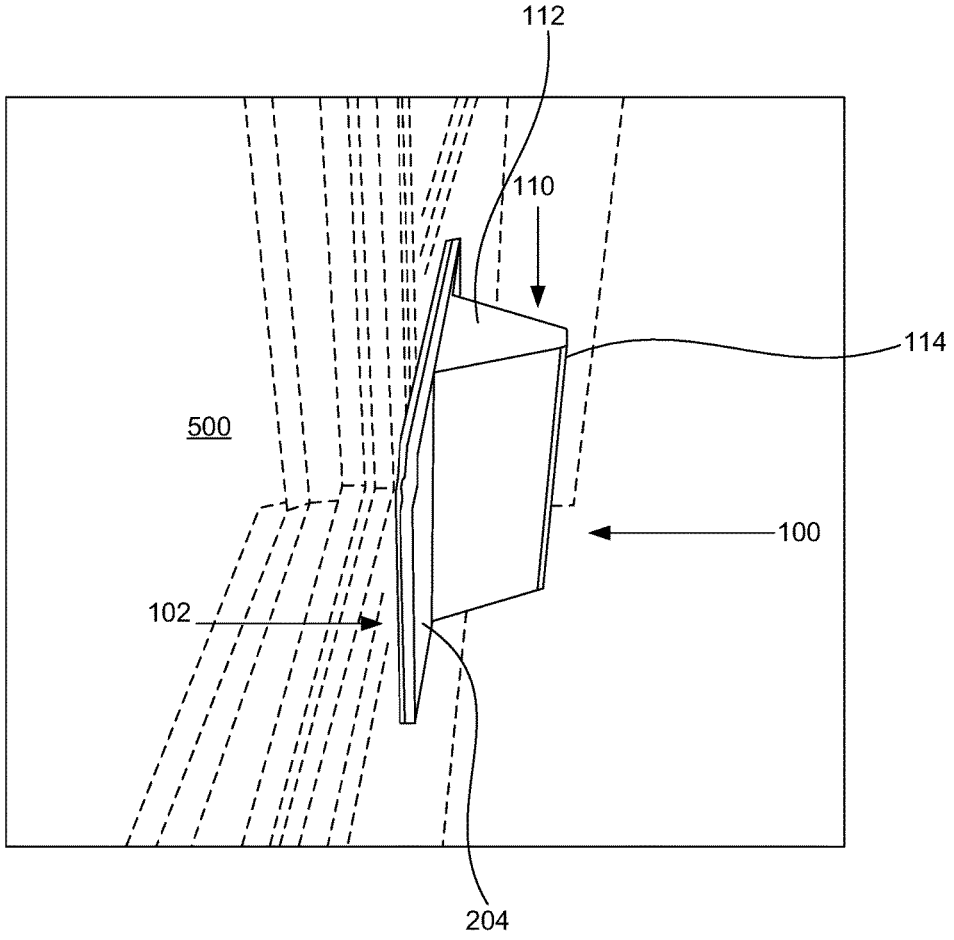
FIG. 5 illustrates a perspective view of a force transmission device aligned coplanar with an exemplary plane, in accordance with an embodiment of the present invention.

FIG. 5 illustrates a perspective view of a force transmission device aligned coplanar with an exemplary plane. The object applies the force to the device, which transmits the force to a panel 500. The device transmits optimal force when positioned at a periphery of the panel. Also, by positioning the device at the periphery of the panel, the foot is closer for displacing the device and panel.

Figure 6A:
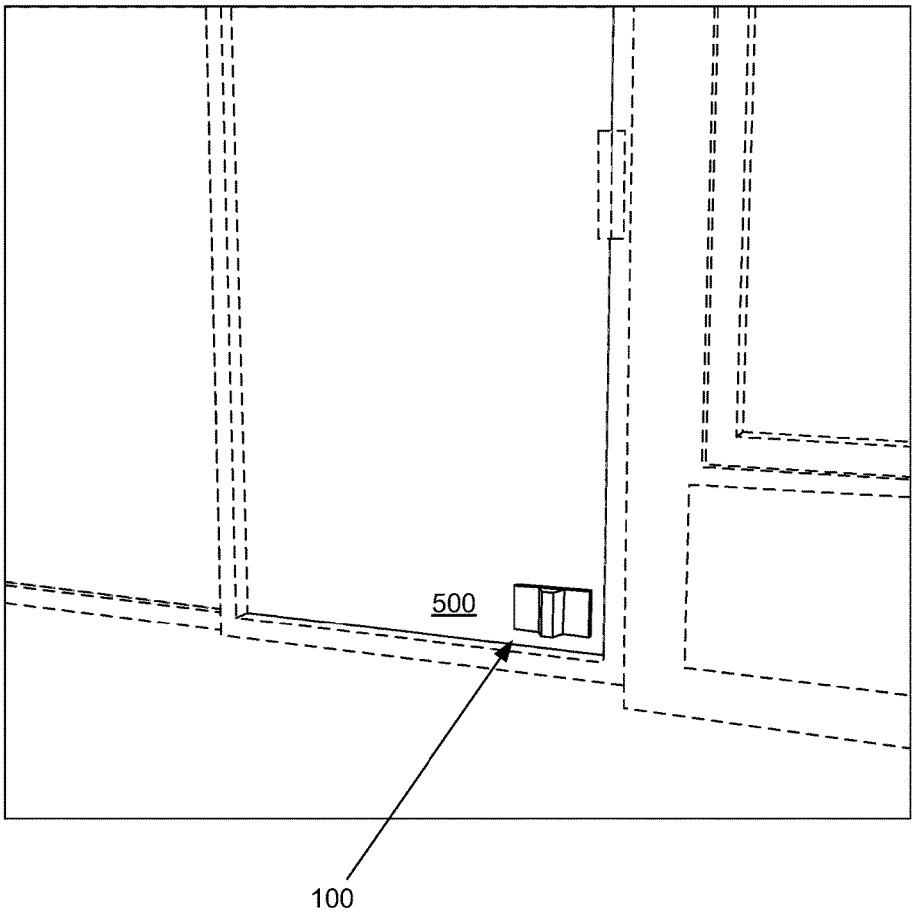
FIGS. 6A and 6B illustrate perspective views of a force transmission device joined with a plane, where
Figure 6B:
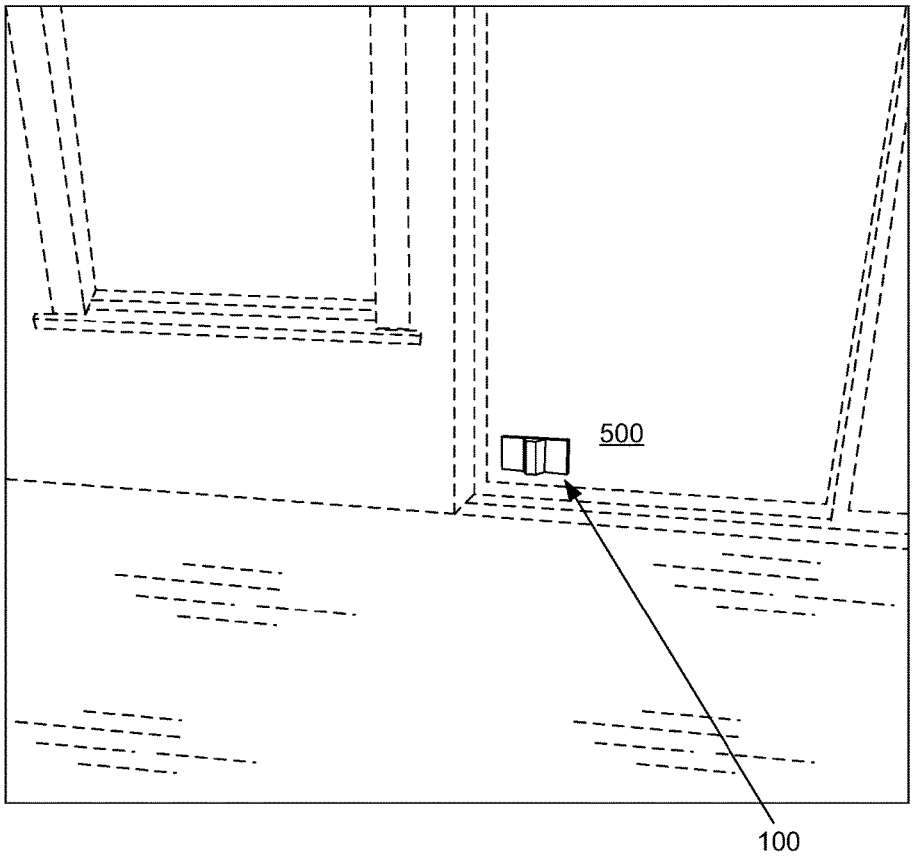

FIGS. 6A and 6B illustrate perspective views of a force transmission device joined with a plane, where FIG. 6A illustrates the force transmission device on an inner side of the plane, and FIG. 6B illustrates the force transmission device on an outer side of the plane. Thus, the device may be used inside or outside a building to facilitate opening and closing of the panel. In one alternative embodiment, two devices aligned with each other may be used on the inner side and outer side of the panel, as shown in FIG. 5.

Figure 7:
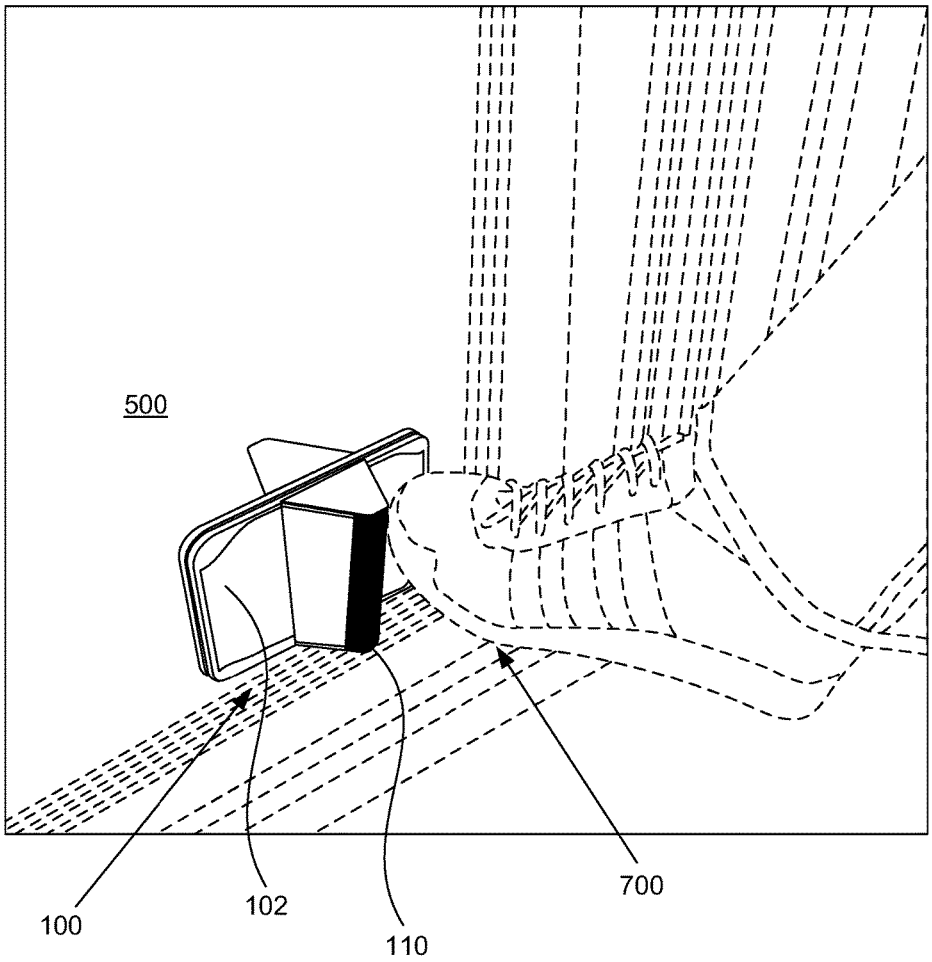
FIG. 7 illustrates a perspective view of an exemplary object applying a lateral force on a force transmission device to slide a plane, in accordance with an embodiment of the present invention.

FIG. 7 illustrates a perspective view of an exemplary object applying a lateral force on a force transmission device to slide a plane. In operation, the device attaches to an outer surface or an inner surface of the plane. The base portion adheres to the panel through use of the adhesive portion. The base portion forms a secure, yet detachable junction with the panel. The wedge extends from the base portion and the panel. An object 700 may apply a lateral force to one of the sidewalls of the wedge portion. The object may include, without limitation, a foot, a hand, an elbow, a rod, and a mechanism. The lateral force displaces both the device and the panel in the direction of the lateral force. Though in some embodiments, the applied force may not be lateral, and rather be oriented to pivotally displace the panel.

Thus, one advantage of the device is that it allows sliding glass doors to slide by use of a foot upon its structure. Another advantage is that it allows sliding glass doors to be opened hands-free and to be opened while carrying items. Yet another advantage is that the device eliminates the need to put items down to open a sliding glass door. Yet another advantage is that the device eliminates the risk of insects and weather elements from entering a home through a temporarily left open sliding glass door. Yet another advantage is that the device eliminates the risk of small children exiting a home through a temporarily left open sliding glass door. Yet another advantage is that the device eliminates the risk of pets exiting a home through a temporarily left open sliding glass door. Yet another advantage is that the device eliminates risks of moving sliding glass doors off-track.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3$^{rd}$ parties. Applicant(s) also reserve its right to later amend the present application to explicitly include citations to such documents and/or explicitly include the functionally corresponding structures which were incorporated by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) has/have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note(s) that all the identified documents above which are incorporated by reference to satisfy 35 USC §112 (6) necessarily have a filing and/or publication date prior to that of the instant application, and thus are valid prior documents to be incorporated by reference in the instant application.

Having fully described at least one embodiment of the present invention, other equivalent or alternative methods of implementing a force transmission device that is configured to laterally displace a plane by joining with the plane and transmitting a lateral force to the plane according to the present invention will be apparent to those skilled in the art. Various aspects of the invention have been described above by way of illustration, and the specific embodiments disclosed are not intended to limit the invention to the particular forms disclosed. The particular implementation of the force transmission device that is configured to laterally displace a plane by joining with the plane and transmitting a lateral force to the plane may vary depending upon the particular context or application. By way of example, and not limitation, the force transmission device described in the foregoing were principally directed to a wedge that attaches to a sliding glass door to enable a foot to slide the glass door implementations; however, similar techniques may instead be applied to a wedge that operates on a cabinet door or a heavy safe door, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

a base portion, said base portion comprising a mount surface and an outer surface, said mount surface comprising an adhesive portion, said adhesive portion being configured to enable adherence of said device, said outer surface comprising a texture portion, said texture portion being configured to help enable gripping said base portion; and a wedge portion, said wedge portion comprising a base end, a wedge end, an apex end and a plurality of sidewalls, said base end being configured to join with said outer surface of said base portion, said apex end and said plurality of sidewalls being configured to receive a force, said apex end and at least a portion of said plurality of sidewalls comprising a plurality of ridges, said plurality of ridges being configured to help enable gripping said apex end and at least a portion of said plurality of sidewalls, wherein said force is substantially transmitted from said wedge portion to said base portion.

2. The device of claim 1, wherein said device is configured to detachably join with a panel.

3. The device of claim 2, wherein said panel includes at least one member selected from the group consisting of: a glass door, a sliding door, a cabinet, and a door.

4. The device of claim 3, wherein said base portion is generally flat and dimensioned at about 6 inches×4 inches×⅓ inches.

5. The device of claim 4, wherein said base portion includes at least one material selected from the group consisting of: a polyvinyl chloride, a butyl rubber, a hypalon rubber, a low-density polyethylene, a metal, and a polymer.

6. The device of claim 5, wherein said texture portion comprises a plurality of small bumps.

7. The device of claim 6, wherein said adhesive portion comprises an ethylene vinyl adhesive.

8. The device of claim 7, further comprising a resilient panel, wherein said resilient panel comprises a polyurethane foam having a depth of about ¼ inches.

9. The device of claim 8, further comprising a cover portion, wherein said cover portion comprises a wax paper.

10. The device of claim 9, in which said cover portion comprises a tab.

11. The device of claim 10, wherein said tab is configured to enable manipulation of said cover portion.

12. The device of claim 11, wherein said wedge portion is a triangular wedge measuring about 2 inches×4 inches×1½ inches.

13. The device of claim 12, wherein said wedge portion is configured to taper to about ½ inch at the apex end.

14. The device of claim 13, wherein said adhesive portion is configured to enable adherence of said device to said panel.

15. The device of claim 14, wherein said wedge portion includes at least one material selected from the group consisting of: a polyvinyl chloride, a butyl rubber, a hypalon rubber, a low-density polyethylene, a metal, and a polymer.

16. The device of claim 15, wherein said force comprises a lateral force.

17. The device of claim 16, wherein said force is configured to transmit from said base portion to said panel.

18. A device consisting of:

a base portion, said base portion comprising a generally flat configuration, said base portion further comprising a mount surface and an outer surface, said mount surface comprising an adhesive portion, said adhesive portion being configured to enable adherence of said device, said outer surface comprising a texture portion, said texture portion being configured to help enable gripping said base portion;

a cover portion, said cover portion being configured to at least partially overlay said adhesive portion, said cover portion further being configured to selectively cover and uncover said adhesive portion;

a tab, said tab being configured to join with said cover portion, said tab further being configured to enable manipulation of said cover portion for selectively covering and uncovering said adhesive portion; and a wedge portion, said wedge portion comprising a base end, a wedge end, an apex end, and a plurality of sidewalls, said base end being configured to join with said outer surface of said base portion, said apex end and said plurality of sidewalls being configured to receive a lateral force, said apex end and at least a portion of said plurality of sidewalls comprising a plurality of ridges, said plurality of ridges being configured to help enable gripping said apex end and at least a portion of said plurality of sidewalls, wherein said lateral force is substantially transmitted from said wedge portion to said base portion.

* * * * *